US006944411B2

(12) United States Patent
Iseki

(10) Patent No.: US 6,944,411 B2
(45) Date of Patent: Sep. 13, 2005

(54) IMAGE FORMING APPARATUS THAT OBTAINS USER INFORMATION

(75) Inventor: Yukimasa Iseki, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 10/454,466

(22) Filed: Jun. 5, 2003

(65) Prior Publication Data

US 2003/0235425 A1 Dec. 25, 2003

(30) Foreign Application Priority Data

Jun. 21, 2002 (JP) ..... 2002-180870

(51) Int. Cl.[7] ..... G03G 15/00
(52) U.S. Cl. ..... 399/80; 399/81; 399/391
(58) Field of Search ..... 399/79, 80, 366, 399/388, 391, 397, 405, 81, 38

(56) References Cited

U.S. PATENT DOCUMENTS 5,029,833 A * 7/1991 Tani et al. ..... 271/9.06
5,452,058 A * 9/1995 Umeda ..... 399/15
5,602,973 A * 2/1997 Nishiwaki ..... 358/1.14
6,694,115 B2 * 2/2004 Weaver ..... 399/80

FOREIGN PATENT DOCUMENTS

JP 07157140 A * 6/1995 ..... B65H/7/06
JP 07302181 A * 11/1995 ..... G06F/3/12
JP 2000351483 A * 12/2000 ..... B65H/7/00

* cited by examiner

*Primary Examiner*—Robert Beatty
(74) *Attorney, Agent, or Firm*—Fitzpatrick, Cella, Harper & Scinto

(57) ABSTRACT

On the basis of information obtained from an IC card and concerning the physical features of a user, it is judged whether or not the user is a handicapped person. When it is judged that the user is a handicapped person, a fixed sheet supply source is not displayed on an LCD of an operation panel. When the user is a handicapped person, therefore, it is possible to inhibit sheet feeding from the fixed sheet supply source, from which it is difficult to remove a jammed sheet.

18 Claims, 4 Drawing Sheets

IMAGE FORMING APPARATUS THAT OBTAINS USER INFORMATION

BACKGROUND OF THE INVENTION

1. Field of the Invention

The present invention relates to an image forming apparatus such as a copying machine, a printer or a facsimile for forming an image by feeding,sheets from a plurality of sheet supply sources.

2. Description of the Related Art

In the related art, an image forming apparatus such as a copying machine is generally constructed to comprise a plurality of sheet supply sources including a main sheet supply source such as a sheet cassette or a sheet tray belonging to the body, or a fixed sheet supply source such as a sheet deck attached to the body detachably. The copying machine of this kind is enabled to form an image on sheets of various sizes either by causing the user to select a sheet supply source with an operation panel or by detecting the document size with a document detecting sensor or a document feeder thereby to select the sheet supply source automatically.

In recent years, moreover, there has been proposed such an apparatus construction for a handicapped person, e.g., a user of a wheeled chair or a visually handicapped person, which can be easily operated by the handicapped person. For example, there is known a technique in which the operation panel is lowered when the handicapped person is recognized, thus allowing the handicapped person to operate on the wheeled chair or in which the visual recognition is improved by enlarging the display letters of the operation panel.

Here, the image forming apparatus for forming an image by transporting sheets is frequently troubled by a problem or a jamming phenomenon of the sheets to be transported.

When the jam occurs at the time of feeding the sheets from a main sheet supply source, a door attached to the side of the apparatus is generally opened. As a result, a sheet feeding path is exposed to the outside space of the apparatus so that the jamming sheet can be confirmed and removed relatively easily.

In most constructions of the sheet deck of the fixed sheet supply source, on the other hand, the sheet feeding path is exposed to the inside space of the apparatus even if the apparatus is opened for removing the jamming sheet. In other words, the jamming sheet cannot be visually confirmed merely from the side or top of the apparatus even when the jam occurs at the time of feeding the sheets from the sheet deck. In this case, the jamming sheet cannot be removed unless the jamming sheet is confirmed by looking up the inside of the sheet deck from below the apparatus.

Thus, the jamming sheet may not be able to be removed in a sheet supply source unless the user changes his or her posture by squatting down or taking a low posture. This makes it difficult for the handicapped person or the user of a wheeled chair to use the apparatus. On the other hand, it is seriously difficult for a weak-sighted person to remove the jamming sheet from deep within the apparatus.

SUMMARY OF THE INVENTION

An object of the invention is to provide an image forming apparatus capable of avoiding a difficult state, in advance, for a handicapped person to remove a jamming sheet.

In order to achieve this object, according to a first aspect of the invention, there is provided an image forming apparatus comprising: a plurality of sheet feeding paths for feeding sheets; image forming means for forming an image on the sheets fed through any of the sheet feeding paths; user information obtain means for obtaining information on the physical features of a user; and control means for making it impossible to use a predetermined sheet feeding path on the basis of the information obtained by the user information obtain means.

It is preferred that the image forming apparatus further comprises: a plurality of sheet supply sources connected individually to the sheet feeding paths; and input means for causing the user to select the sheet supply source to be used, wherein the control means makes it impossible to select the sheet supply source connected to the predetermined sheet feeding path from the input means when it is judged that the user is a handicapped person.

It is preferred that the predetermined sheet feeding path is more difficult than the remaining sheet feeding paths for the user to remove the jamming sheet.

According to a second aspect of the invention, there is also provided an image forming apparatus comprising: a first sheet supply source connected to a first sheet feeding path which is exposed to the outside space of the apparatus when the apparatus is opened for removing a jamming sheet; a second sheet supply source connected to a second sheet feeding path which is exposed to the inside space of the apparatus when the apparatus is opened for removing a jamming sheet; image forming means for forming an image on the sheets fed through the first sheet feeding path or the second sheet feeding path; user information obtain means for obtaining information on the physical features of a user; and control means for selecting the sheet supply source to be used on the basis of the information obtained by the user information obtain means.

It is preferred that the control means selects the first sheet supply source as one to be preferentially used, when it is judged on the basis of the information that the user is a handicapped person.

It is preferred that the control means selects the sheet supply source to be used on the basis of the size of the image to be formed, the control means selects the second sheet supply source as one to be used and sets the feed interval from the second sheet supply source larger than an ordinary feed interval, when it is judged on the basis of the information that the user is a handicapped person and when the sheets corresponding to the size of the image are stored only in the second sheet supply source.

DESCRIPTION OF THE PREFERRED EMBODIMENTS

Preferred embodiments of this invention will be illustratively described in detail with reference to the accompanying drawings. However, the sizes, material, shapes and relative arrangements of components, as specified in the embodiments, are not intended to limit the scope of the invention thereto, unless otherwise specified.

(First Embodiment)

Figure 1:
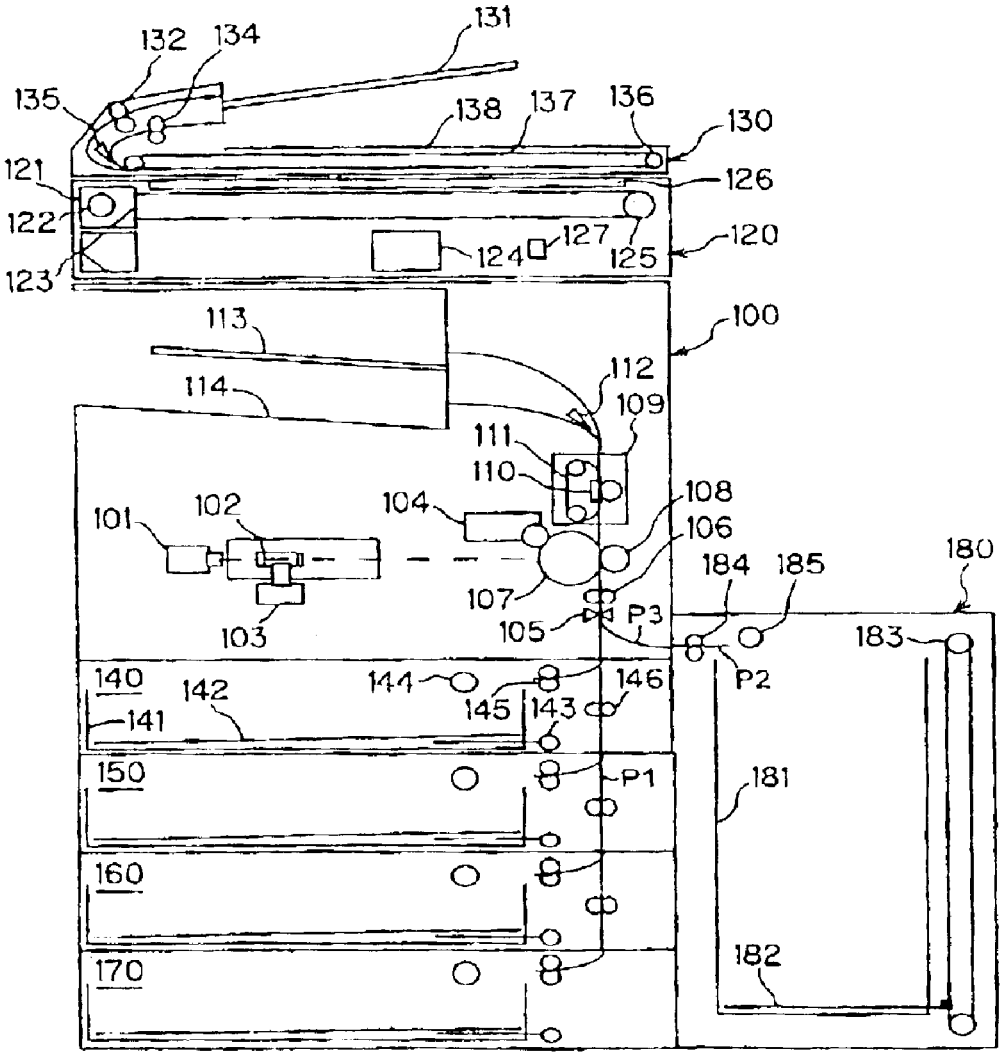
FIG. 1 is a sectional diagram showing a schematic construction of an image forming apparatus.

FIG. 1 is a sectional diagram showing a schematic construction of a digital multifunction imaging apparatus as an image forming apparatus according to a first embodiment of the invention. The body construction will be described with reference to the accompanying drawings.

An auto document feeder 130 is constructed in the following manner.

A document feeding roller 132 separates and feeds the documents set on a document tray 131, sheet-by-sheet. The document is then conveyed to a document reading position by a document conveying belt 137 driven by a motor 136. And, the document is read by a document reading unit 120 acting as document reading means. After the document is read, its conveying path is changed by a flapper 135. After this, the motor 136 is reversed to discharge the document through a discharge roller 134 to an output tray 138.

The document reading unit 120 is constructed in the following manner.

An exposure lamp 122 is made of a fluorescent lamp, a halogen lamp or the like. This exposure lamp 122 irradiates the document on a platen glass 126 while moving in a direction (i.e., in a transverse direction of the drawing) perpendicular to its longitudinal direction. The light, as scattered from the document by the irradiation of the exposure lamp 122, is so reflected by first and second mirror units 121 and 123 as to arrive at a lens 124. At this time, the second mirror unit 123 moves at a half speed of the first mirror unit 121 thereby to keep always constant the distance from the irradiated document surface to the lens 124. The first mirror unit 121 and the second mirror unit 123 are driven by a motor 125. An image on the document is focused through the first and second mirror units 121 and 123 and the lens 124 on a receiving portion of a CCD line sensor 127 having several thousands of light receiving elements arrayed on line and is sequentially converted photoelectrically at a line unit by the CCD line sensor 127. Signals thus photoelectrically converted are processed by the not-shown signal processing unit so that they are PWM-modulated and outputted.

An image forming unit 100 to act as image forming means for forming an image on a sheet is constructed in the following manner.

A residual charge is removed from a drum-shaped photosensitive member 107, before being irradiated with an optical beam, by a pre-exposure lamp, and the photosensitive member 107 is charged homogenously on its surface by a primary charger. On the basis of the PWM-modulated image signals, the output of the signal processing unit, the exposure controller activates a semiconductor laser 101 to irradiate the surface of the photosensitive member 107 rotating at a constant speed, with the optical beam. At this time, a polygon mirror 102 to be rotationally driven by a motor 103 is used to deflect and scan the optical beam in parallel with the axial direction of the photosensitive member 107. As a result, an electrostatic latent image is formed on the surface of the photosensitive member 107. And, a developing unit 104 visualizes the electrostatic latent image on the surface of the photosensitive member 107 with a developer (or a toner) of a predetermined color.

A recording sheet, as fed from any of main sheet supply sources 140, 150, 160 and 170 and a fixed sheet supply source 180 arranged on the side of the apparatus body, is conveyed to a registration roller 106. This registration roller 106 detects the arrival of the sheet by using a sensor 105 and feeds the sheet to a transfer position while timing the leading end of the image formed on the photosensitive member 107 to the leading end of the sheet.

A transfer charger 108 transfers the developed toner image on the photosensitive member 107 to the sheet fed. After this transfer, the photosensitive member 107 is cleared of the toner left on the photosensitive member 107, by the not-shown cleaner.

Because of a large curvature of the photosensitive member 107, the transferred sheet is easily separated from the photosensitive member 107. This easy separation is further promoted if the adsorptivity between the photosensitive member 107 and the sheet is weakened by applying a voltage to the not-shown charge removal needle.

The separated sheet is conveyed to a fixing unit 109 and fixed with a toner. This fixing unit 109 is constructed of a ceramic heater 110, a film 111 and two rollers. The heat of the ceramic heater 110 is efficiently transferred through the thin film 111 to the sheet. The heat of the fixing unit rollers is released by a cooling roller. The feeding roller is composed of one large roller and two small rollers and feeds the sheet coming from the fixing unit while straightening it.

A direction flapper 112 switches the discharge destination of the sheet to a tray 113 or a tray 114 in accordance with the operation mode.

The four main sheet supply sources 140, 150, 160 and 170 are stacked in the lower portion of the apparatus body. These individual main sheet supply sources are connected to a first sheet feeding path P1 starting from the lower portion and extending upward of the apparatus body. On the other hand, the fixed sheet supply source 180 is one capable of stacking more sheets than those of the main sheet supply sources 140, 150, 160 and 170 and includes a second sheet feeding path P2 in the upper portion. This second sheet feeding path P2 merges into the first sheet feeding path P1 upstream of the registration roller 106 via a third sheet feeding path P3 disposed on the apparatus body side.

The main sheet supply sources 140, 150, 160 and 170 have substantially identical constructions and will be described with reference to the main sheet supply source 140 as an example.

On the bottom face of a cassette 141 for stacking the sheets, there is arranged a bottom plate 142, which is moved up and down by a lift-up motor 143. When this bottom plate 142 is lifted up, the sheet can be brought to a predetermined height in a standby state.

The sheet on standby at the predetermined position is conveyed by a pickup roller 144 to a feed roller pair 145. One roller of the feed roller pair 145 is biased in a sheet feeding direction whereas the other roller is biased in the opposite direction. As a result, the feed roller pair 145 delivers the sheets one-by-one to the first sheet feeding path P1 while preventing their overlapping. Moreover, a transport roller 146 transports the sheets, as transported from the main sheet supply sources below the main sheet supply source 140, further upward.

The fixed sheet supply source 180 is a sheet deck and is constructed in the following manner.

In a sheet storage 181 for stacking the sheets, there is arranged a bottom plate 182 for lifting up the sheet to a standby position. This bottom plate 182 is connected to a turning belt driven by a motor 183. As this turning belt is moved, the bottom plate 182 is moved up or down. The sheet at the standby position is conveyed by a pickup roller 185 to a feed roller pair 184. This feed roller pair 184 transports, like those of the main sheet supply sources, the sheets to the second sheet feeding path P2 while preventing their overlapping.

<Jam in Main Sheet Supply Sources>

When a jam occurs in the sheet fed from the main sheet supply sources 140, 150, 160 and 170, the jamming sheet is located either in the first sheet feeding path P1 extending upward from below the body or between the feed roller pair 145 and the first sheet feeding path P1.

For countermeasures against the jam, the fixed sheet supply source 180 is slid rightward of the drawing to leave the apparatus body. After this, the (not-shown) door attached to the side of the apparatus body is opened to make the apparatus body be in an open state. As a result, the first sheet feeding path P1 is exposed to the outside space of the apparatus. Therefore, the jamming sheet in the first sheet feeding path P1 can be visually recognized at a glance and can be easily removed. Moreover, the distance from the feed rollers to the first sheet feeding path P1 is short so that the jamming sheet can be easily removed.

<Jam in Fixed Sheet Supply Source>

When a jam occurs in the sheet fed from the fixed sheet supply source 180, the jamming sheet is located either in the second sheet feeding path P2 in the upper portion of the fixed sheet supply source 180 or in the third sheet feeding path P3, which is on the side of the apparatus body and is connected to the second sheet feeding path P2.

For countermeasures against the jam, the fixed sheet supply source 180 is slid rightward of the drawing to leave the apparatus body. After this, the (not-shown) door attached to the side of the apparatus body is opened to make the apparatus body be in an open state. As a result, the third sheet feeding path P3 is exposed to the outside space of the apparatus. Therefore, the jamming sheet in the third sheet feeding path P3 can be visually recognized at a glance and can be easily removed.

Next, a (not-shown) door attached to the front face of the fixed sheet supply source 180 is opened to make the fixed sheet supply source 180 be in an open state. Then, the second sheet feeding path P2 is exposed to the side of the sheet storage 181 or the inside space of the apparatus so that the jamming sheet can be removed. In this case, the user squats down or takes a low posture and looks up from the inside of the sheet storage 181 to visually recognize the jamming sheet in the second sheet feeding path P2 and remove it.

This is because the construction of the fixed sheet supply source 180 makes it necessary to elongate the length of the second sheet feeding path P2 to some extent, thereby to make it sometimes impossible to extract the jamming sheet left in the second sheet feeding path P2 from the outside of the apparatus.

These countermeasures against the jam of the fixed sheet supply source 180 are seriously difficult for a handicapped person such as a user of a wheeled chair or a visually handicapped person. For example, the wheeled chair user is required to get off the chair and squat down in a low posture, and the visually handicapped person is required to groping for the complicated mechanism in the fixed sheet supply source 180.

It is, however, hard to provide the upper or side face of the apparatus with an additional door for the countermeasures against the jam so as to retain the apparatus strength of the fixed sheet supply source 180.

Therefore, the embodiment performs controls to judge whether the user is a handicapped person or not and to switch the usable sheet supply source automatically.

Figure 2:
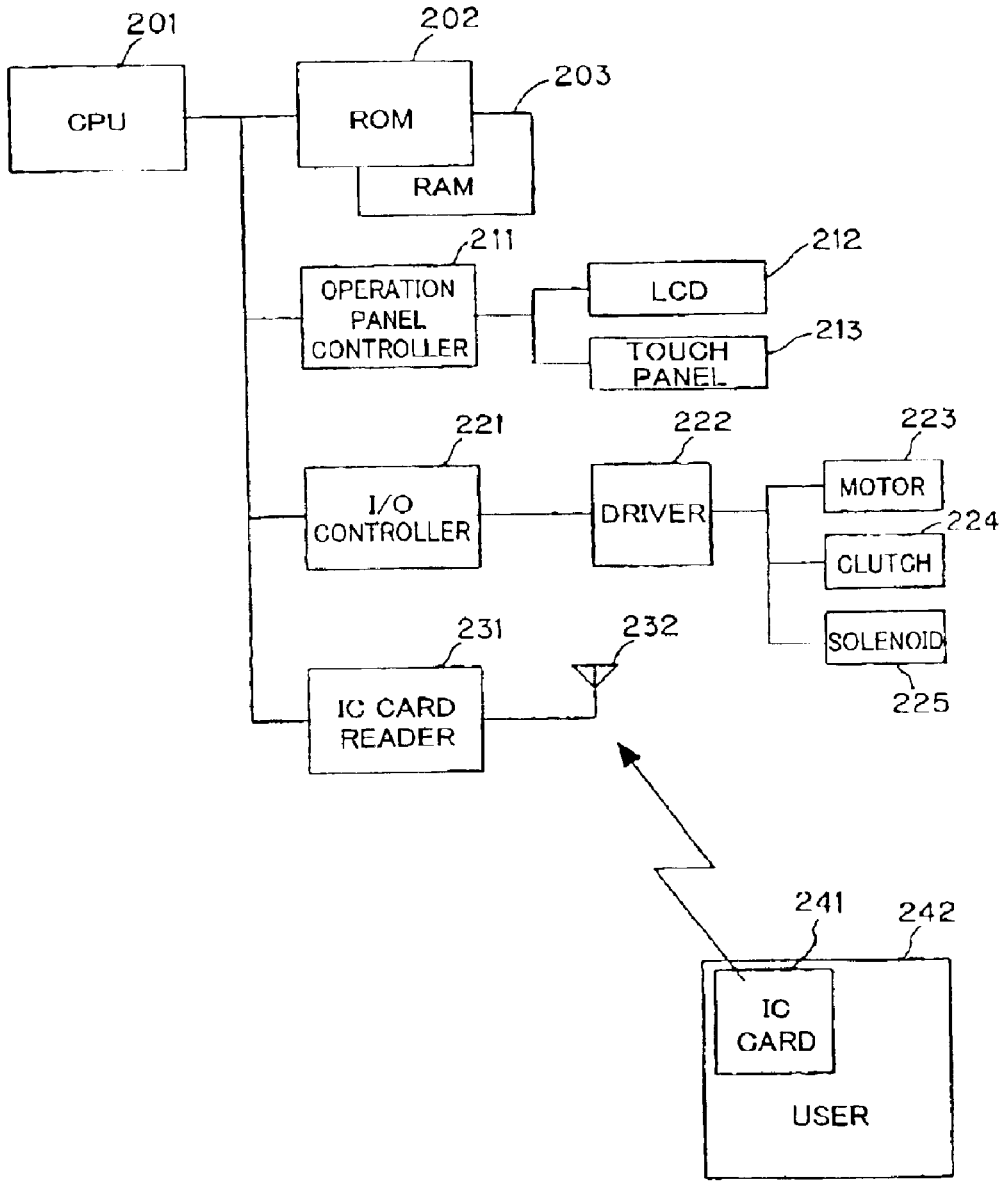
FIG. 2 is a block diagram showing a control circuit.

FIG. 2 is a block diagram showing a control circuit of the image forming apparatus.

A controlling CPU 201 is control means for controlling the individual units sequentially by using a ROM 202 and a RAM 203. An operation panel controller 211 controls/detects an LCD 212 acting as display means for displaying information to a user 242, and a touch panel 213 acting as input means for the user 242 to input the information.

An I/O controller 221 controls a motor 223, a clutch 224, a solenoid 225 and and so on, as needed for the sheet transport, through a driver 222 on the basis of an instruction from the CPU 201. Although not shown, signals from various sensors are also inputted by the I/O controller 221.

An IC card reader 231 is means (or user information obtain means) for reading the information from an IC card 241 or an information recording medium owned by the user 242. Specifically, the IC card reader 231 receives electric waves from the IC card 241 at an antenna 232, and decodes the received data into such an information mode as can be understood by the CPU 201.

By using the device shown in FIG. 2, it is possible not only to discriminate the information from the user, but also to present the information to the user, to input the information from the user and to control the transporting of the sheet.

Figure 3:
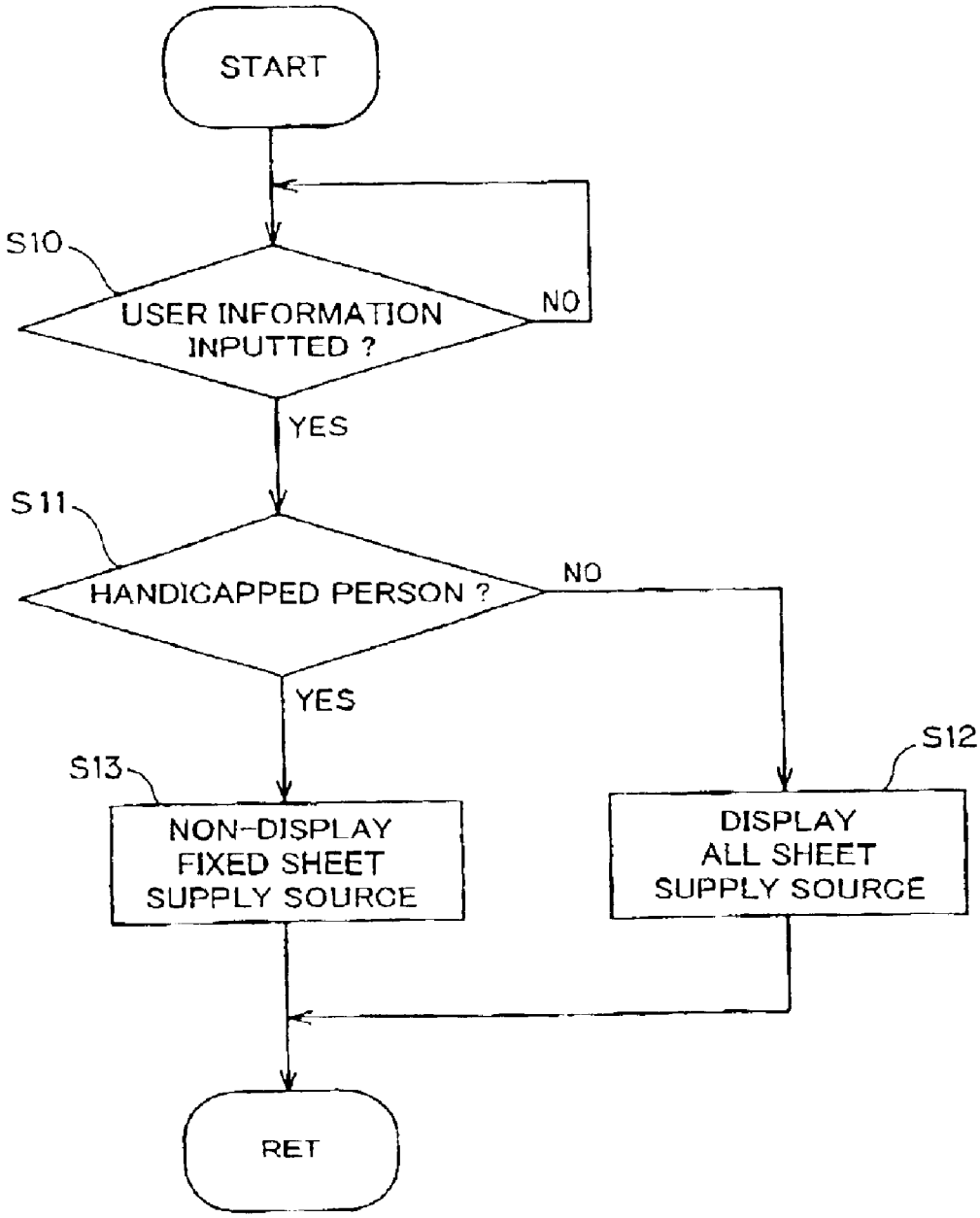
FIG. 3 is a flow chart of a selection of a sheet supply source.

FIG. 3 is a flow chart showing the case considering a handicapped person by using the control circuit of FIG. 2. The procedure shown in FIG. 3 is controlled, operated or executed by the aforementioned controlling CPU.

First of all, a standby is made until, at Step S10, information is input from the IC card owned by the user.

When the electric waves from the IC card are detected, the information recorded in the IC card is read by the IC card reader. And, the information on the physical features of the user, as contained in that information, is obtained to judge whether or not the user is a handicapped person (at Step S11).

In case it is judged that the user is not handicapped, all the sheet supply sources including the fixed sheet supply source are brought into usable states. Specifically, the information indicating all the sheet supply sources (that is, the main sheet supply sources and the fixed sheet supply source) is displayed in the operation panel (at Step S12) so that a desired one of the sheet supply sources can be selected by the user. This is because the user can take, if not handicapped, a squatting posture for undertaking countermeasures against a jam. Even if the jam occurs at the time of feeding the sheet from the fixed sheet supply source, therefore, the jamming sheet can be removed without any problem.

In case it is judged that the user is a handicapped person, on the other hand, the sheet feed from the fixed sheet supply source or the second sheet feeding path is inhibited. Specifically, only the information indicating the main sheet supply sources, i.e., not the information indicating the fixed sheet supply source, is displayed on the LCD of the operation panel (at Step S13) so that the fixed sheet supply source cannot be selected.

As a result, the sheet feed from the fixed sheet supply source is not done, when the handicapped person uses the apparatus, so that the jam can be prevented from occurring in the second sheet feeding path.

Therefore, it is possible to avoid, in advance, a jammed state that is difficult for a handicapped user to cope with, thus improving convenience for the handicapped person.

Moreover, the selectable sheet supply sources are switched by reading the information in a non-contact manner from the IC card owned by the user and by judging whether or not the user is a handicapped person. It is, therefore, possible to improve the convenience of the apparatus without deteriorating the user-friendliness for the user.

(Second Embodiment)

Figure 4:
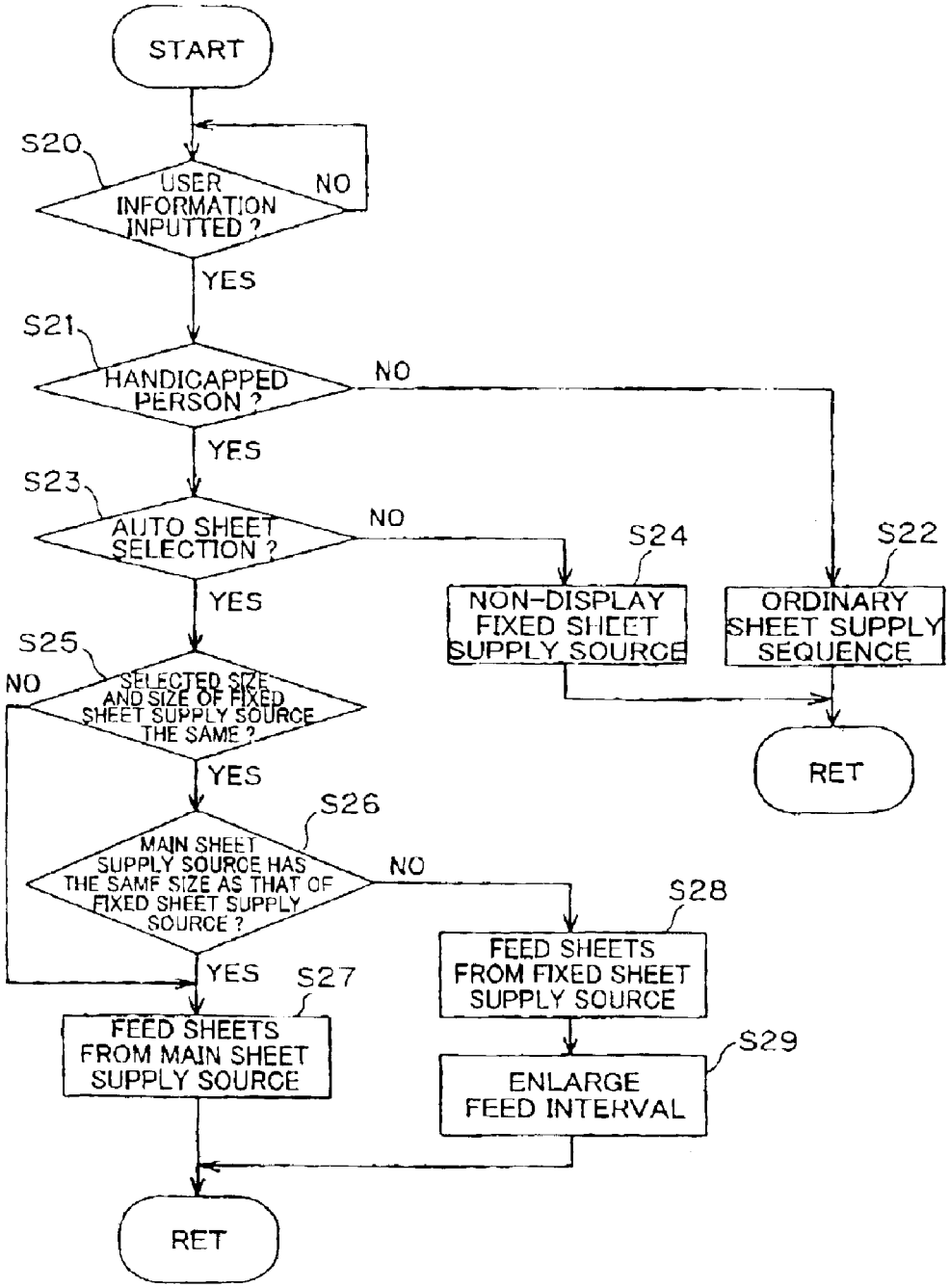
FIG. 4 is a flow chart of an auto sheet selecting function.

FIG. 4 shows a second embodiment of the invention. The foregoing first embodiment presents the construction in which the sheet supply source to be used is selected by the user. However, this embodiment presents a construction in which the sheet supply source to be used is automatically selected according to the size of the image to be formed.

Here is omitted the detailed description on the construction of the image forming apparatus and the construction of the circuit, because they are identical to those described with reference to FIG. 1 and FIG. 2.

This image forming apparatus has "auto sheet selecting" functions to recognize the document size, when the document is placed on the platen glass 126 or when the document is fed by the auto document feeder 130, and to switch the sheet supply sources to be used, on the basis of the document size recognized and the function set (e.g., magnification).

Generally in the auto sheet selection, the preferential order of the sheet supply sources is set in the following manner.

In one case where sheets of the same size are piled on a plurality of main sheet supply sources, preference is taken to the feed of the sheets of the higher stage. This is because the main sheet supply source of the higher stage has the shorter time to arrive at the photosensitive member 107.

In case sheets of the same size are piled on the fixed sheet supply source and the main sheet supply sources, moreover, the preference is taken to the feed of the sheets from the fixed sheet supply source. This is because the fixed sheet supply source stores more sheets than the main sheet supply sources. This is because consideration is taken into the convenience of the user.

With these premises, whether or not the user is a handicapped person is judged in this embodiment, and the sheet supply source to be used is selected by the following logic. FIG. 4 is a flow chart showing an auto sheet selecting function.

The procedure up to the steps (i.e., Steps S20 and S21) of judging whether or not the user is a handicapped person is identical to that (of Steps S10 and S11 of FIG. 3) of the first embodiment.

In case it is judged at Step S21 that the user is not handicapped, an ordinary sheet feeding sequence is taken (at Step S22). In the auto sheet selecting mode, more specifically, the sheet supply source to be used is selected according to the aforementioned preferential order of the sheet supply sources. In another mode, the sheet supply source to be used is selected according to the size selected by the user.

In case it is judged that the user is a handicapped person, on the other hand, it is examined (at Step S23) whether or not the mode is for the auto sheet selection.

In the case other than the auto sheet selecting mode, the feed from the fixed sheet supply source, i.e., the second sheet feeding path, is inhibited (at Step S24). This operation is identical to that of Step S13 of the first embodiment.

In the case of the auto sheet selecting mode, the procedure transfers to the selection/decision of a sheet supply source. At first, the size of an image to be formed (as will be called the "selected size") is calculated on the basis of the document size recognized and the function (e.g., the magnification) set. It is then examined (at Step S25) whether or not the selected size and the size of the sheets stored in the fixed sheet supply source are the same.

In case the sheets of the selected size are not stored in the fixed sheet supply source but only in the main sheet supply sources, they are fed from main sheet supply sources (at Step S27).

In case the sheets of the selected size are stored in the fixed sheet supply source, it is examined (at Step S26) whether or not sheets of the same size are also stored in any of the main sheet supply sources. In case it is known that the sheets of the same size are also stored in one of the main sheet supply sources connected to the first sheet feeding path, the main sheet supply source is selected (at Step S27) as the one to be used, to the contrary of the aforementioned preferential order of the sheet supply sources.

In case it is known at Step S26 that the sheets of the selected size are stored only in the fixed sheet supply source connected to the second sheet feeding path, this fixed sheet supply source is selected as the one to be used (at Step S28), and the feed interval from the fixed sheet supply source is set larger than the ordinary one (at Step S29) for the sheet feeding operations.

According to the construction thus far described, the sheet feed from the main sheet supply sources never fails to occur when the handicapped person uses the aforementioned apparatus, in case the main sheet supply sources and the fixed sheet supply source have the sheets of the same size. Therefore, it is possible to prevent the jam from occurring in the second sheet feeding path. Even at the time of using the highly useful auto sheet selecting function, therefore, it is possible to avoid the jammed state that is difficult for the handicapped person to cope with, and it is accordingly possible to improve convenience for the handicapped person.

In case the sheets of the size corresponding to the image to be formed are only in the fixed sheet supply source, moreover, the probability of jam occurrence can be lowered by enlarging the feed interval more than ordinary.

As has been described hereinbefore, according to the invention, it is possible to avoid the jammed state that is difficult for a handicapped person to cope with, and it is therefore possible to improve convenience for the handicapped person.

What is claimed is:

1. An image forming apparatus comprising:

a plurality of sheet feeding paths for feeding sheets;

a plurality of sheet supply sources connected individually to said sheet feeding paths;

image forming means for forming an image on the sheets fed through any of the sheet feeding paths;

user information obtain means for obtaining information on the physical features of a user;

input means for causing the user to select the sheet supply source to be used; and control means for making it impossible to select the sheet supply source connected to a predetermined sheet feeding path using said input means, when it is judged on the basis of the information obtained by said user information obtain means that the user is a handicapped person.

2. An image forming apparatus according to claim 1, wherein said predetermined sheet feeding path is exposed to an inside space of the apparatus when the apparatus is opened for removing a jamming sheet.

3. An image forming apparatus according to claim 1, wherein said predetermined sheet feeding path is more difficult than the remaining sheet feeding paths for the user to remove the jamming sheet.

4. An image forming apparatus according to claim 1, wherein the sheet supply source connected to said predetermined sheet feeding path is a fixed sheet supply source arranged on a side of a body of the apparatus.

5. An image forming apparatus according to claim 1, wherein said user information obtain means reads said information on the physical features of the user from an information recording medium owned by the user.

6. An image forming apparatus according to claim 5, wherein said information recording medium is a non-contact type IC card.

7. An image forming apparatus comprising:

a first sheet supply source connected to a first sheet feeding path which is exposed to an outside space of the apparatus when the apparatus is opened for removing a jamming sheet;

a second sheet supply source connected to a second sheet feeding path which is exposed to an inside space of the apparatus when the apparatus is opened for removing a jamming sheet;

image forming means for forming an image on the sheets fed through said first sheet feeding path or said second sheet feeding path;

user information obtain means for obtaining information on the physical features of a user; and control means for selecting the sheet supply source to be used on the basis of the information obtained by said user information obtain means.

8. An image forming apparatus according to claim 7, wherein said control means selects said first sheet supply source as one to be preferentially used, when it is judged on the basis of said information that the user is a handicapped person.

9. An image forming apparatus according to claim 7, wherein said control means selects the sheet supply source to be used on the basis of the size of the image to be formed, said control means selects said second sheet supply source as one to be used and sets the feed interval from said second sheet supply source larger than an ordinary feed interval, when it is judged on the basis of said information that the user is a handicapped person and when the sheets corresponding to the size of said image are stored only in said second sheet supply source.

10. An image forming apparatus according to claim 7, wherein the second sheet supply source is a fixed sheet supply source arranged on a side of a body of the apparatus.

11. An image forming apparatus according to claim 7, wherein said user information obtain means reads said information on the physical features of the user from an information recording medium owned by the user.

12. An image forming apparatus according to claim 11, wherein said information recording medium is a non-contact type IC card.

13. An image forming apparatus comprising:

a plurality of sheet feeding paths for feeding sheets;

a plurality of sheet supply sources connected individually to said sheet feeding paths;

image forming means for forming an image on the sheets fed through any of the sheet feeding paths;

user information obtain means for obtaining information on the physical features of a user; and control means having a normal sheet feeding mode and an auto sheet selecting mode, wherein when it is judged that the user is a handicapped person on the basis of the information obtained by said user information obtain means:

in the normal sheet feeding mode, said control means makes it impossible to use a predetermined sheet feeding path; and in the auto sheet selecting mode, said control means examines whether or not sheets of a selected size are also stored in another sheet supply source different from the sheet supply source connected to the predetermined sheet feeding path, and uses said another sheet supply source when sheets of the selected size are also stored in said another sheet supply source.

14. An image forming apparatus according to claim 13, wherein said control means controls a feed interval from the predetermined sheet feeding path so that the interval is larger than that in the ordinary sheet feeding operations when the sheets of the selected size are stored only in the sheet supply source connected to said predetermined sheet feeding path.

15. An image forming apparatus according to claim 13, wherein said predetermined sheet feeding path is more difficult than the remaining sheet feeding paths for the user to remove the jamming sheet.

16. An image forming apparatus according to claim 13, wherein the sheet supply source connected to said predetermined sheet feeding path is a fixed sheet supply source arranged on a side of a body of the apparatus.

17. An image forming apparatus according to claim 13, wherein said user information obtain means reads said information on the physical features of the user from an information recording medium owned by the user.

18. An image forming apparatus according to claim 17, wherein said information recording medium is a non-contact type IC card.

* * * * *

UNITED STATES PATENT AND TRADEMARK OFFICE

CERTIFICATE OF CORRECTION

PATENT NO. : 6,944,411 B2
DATED : September 13, 2005
INVENTOR(S) : Iseki

It is certified that error appears in the above-identified patent and that said Letters Patent is hereby corrected as shown below:

Column 1,
Line 9, “feeding,sheets” should read -- feeding sheets --.

Column 5,
Line 52, “groping” should read -- grope --.

Signed and Sealed this

Twenty-eighth Day of March, 2006

JON W. DUDAS
*Director of the United States Patent and Trademark Office*